US005520239A

United States Patent [19]

Sakata

[11] Patent Number: 5,520,239

[45] Date of Patent: May 28, 1996

[54] Z-SHAPE CAST STRAND WITHDRAWAL AND STRAIGHTENING UNIT FOR CONTINUOUS CASTING MACHINE

[75] Inventor: Yutaka Sakata, Niihama, Japan

[73] Assignee: Sumitomo Heavy Industries Ltd., Tokyo, Japan

[21] Appl. No.: 334,339

[22] Filed: Nov. 2, 1994

[51] Int. Cl.[6] ..... B22D 11/08; B22D 11/20; B22D 11/128

[52] U.S. Cl. ..... 164/154.5; 164/442; 164/448; 164/483

[58] Field of Search ..... 164/442, 448, 164/484, 483, 154.5, 454

[56] References Cited

U.S. PATENT DOCUMENTS 3,543,830 12/1970 Baumann ..... 164/484
3,773,099 11/1973 Rossi ..... 164/484

FOREIGN PATENT DOCUMENTS 2081149 2/1980 United Kingdom ..... 164/448
2105229 3/1983 United Kingdom ..... 164/442

*Primary Examiner*—Kuang Y. Lin
*Attorney, Agent, or Firm*—Nikaido, Marmelstein, Murray & Oram

[57] ABSTRACT

There is disclosed a Z-cast steel strand withdrawal/straightening unit for a continuous casting machine which comprises a dummy bar press roller and a cast steel strand press roller which have different shapes, and are positioned at a drawing/unbending section in such a manner that they can be separately pressed and released, whereby the dummy bar press roller and the cast steel strand press roller are controlled to be pressed and released by a signal from a detector which detects the movement of a cast steel strand and a dummy bar so that even a deformed cast steel strand with different roller contact surface heights can be drawn and unbent, and a dummy bar can be drawn.

2 Claims, 6 Drawing Sheets

Z-SHAPE CAST STRAND WITHDRAWAL AND STRAIGHTENING UNIT FOR CONTINUOUS CASTING MACHINE

BACKGROUND OF THE INVENTION

1. Field of the Invention

This invention relates to a straightening unit for cast strand in a continuous casting machine, and, more particularly, to a Z-shape strand withdrawal/straightening unit which, in a bow type or vertical type continuous casting machine, a Z-shape strand with a unsymmetric cross section having a different roll contact surface height at each side on the top surface is unbent and drawn by press rolls.

2. Description of the Related Art

In a bow type continuous casting machine or a vertical bending type continuous casting machine, a cast strand exiting from a mold being solidified is drawn downward in strand guide by a series of pinch rollers, unbent to a horizontal state at a straightening unit near the exit by a press roller, and cut into a predetermined length to be made a bloom or beam blank as the final cast steel strand. A plurality of press roller stands for straightening a cast steel strand while drawing are positioned at a straightening unit, and, at the beginning of casting, a dummy bar is drawn by the pressure and rotation of these press rollers. Then, the initial cast strand guided in a curved state following the dummy bar is pressed down and drawn while unbending to a straight state.

Conventionally, many cast steel strand such as beam blanks, blooms, or slabs produced by such continuous casting machine have a rectangular cross section with flat and parallel top and bottom surfaces. Alternatively, a beam blank may have the deformed cross section as shown in FIG. 1. Even in this case, top roller contact surfaces 1*c*, 1*d* are formed at the same height in respect to bottom roll contact surfaces 1*a*, 1*b*. It is unbent and drawn by a press roller with a flat rolling surface. Therefore, a dummy bar 2 supporting the beam blank 1 and providing the drawing force for it (FIG. 2) is also pressed and drawn on its roller contact surfaces 2*a*, 2*b*, 2*c*, and 2*d* by the same press roller. However, a Z-cast strand as shown in FIG. 3 has different heights $H_1$, $H_2$ on the top roller contact surfaces 3*b*, 3*c* in respect to a bottom roller contact surface 3*a*. Therefore, the top press roller must be a roller with a different diameter as shown in FIG. 6. In this case, a dummy bar 2 with a flat top and bottom roller contact surfaces cannot be pressed and drawn. Thus, such Z-cast strand have not been manufactured by a conventional continuous casting process.

SUMMARY OF THE INVENTION

The object of the present invention is to provide a Z-shape strand withdrawal/straightening unit for a continuous casting machine in which even such deformed cast steel strand with different roller contact surface heights can be drawn and unbent, and a dummy bar can be drawn.

The Z-cast steel strand withdrawal/straightening unit for a continuous casting machine according to the present invention comprises a dummy bar press roller and a cast steel strand press roller which have different shapes, and are positioned at a withdrawal/straightening unit in such a manner that they can be separately pressed and released, whereby the dummy bar press roller and the cast steel strand press roller are controlled to be pressed and released by a signal from a detector which detects the movement of a cast steel strand and a dummy bar.

DESCRIPTION OF THE PREFERRED EMBODIMENT

Figure 1:
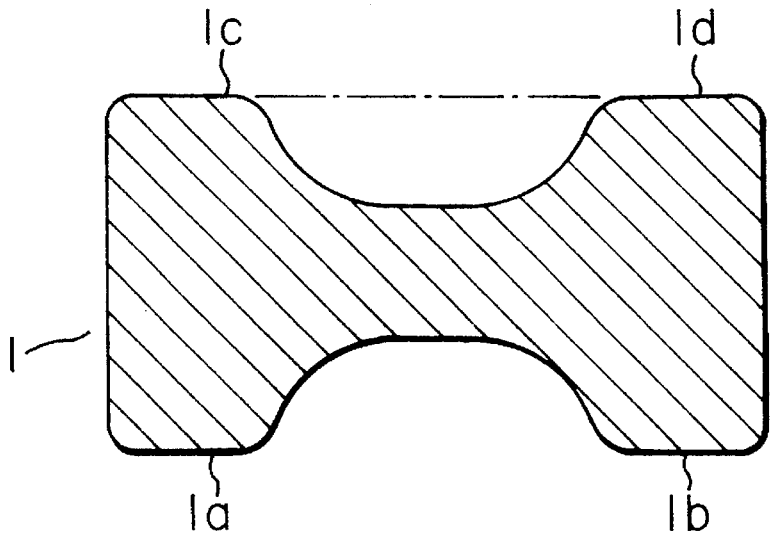
FIG. 1 PRIOR ART
FIG. 1 is a cross-sectional view of a beam blank with parallel top and bottom roller contact surfaces.
Figure 2:
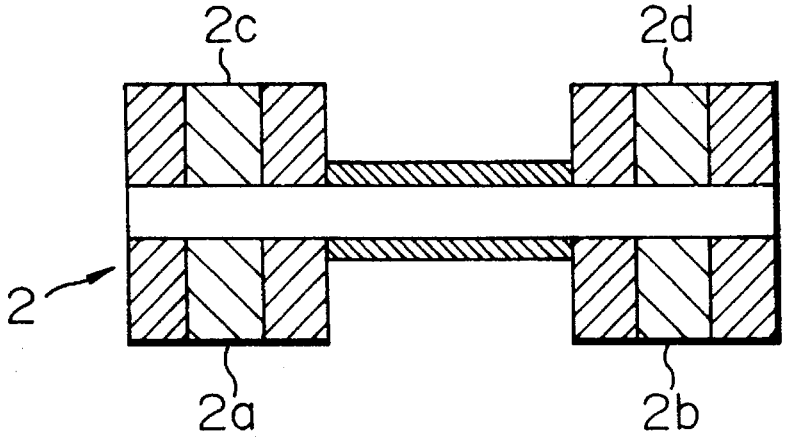
FIG. 2 PRIOR ART
FIG. 2 is a cross-sectional view of a dummy bar.
Figure 3:
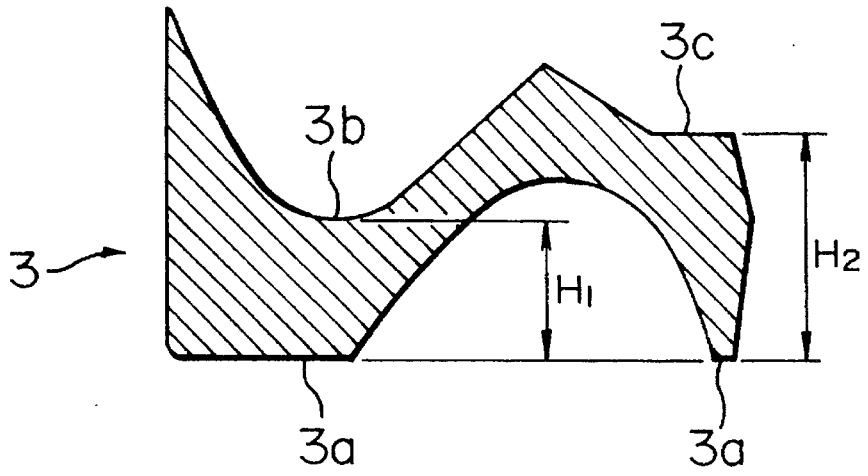
FIG. 3 is a cross-sectional view of an example of a Z-cast steel strand having a top roller contact surface with different heights at each side.
Figure 4:
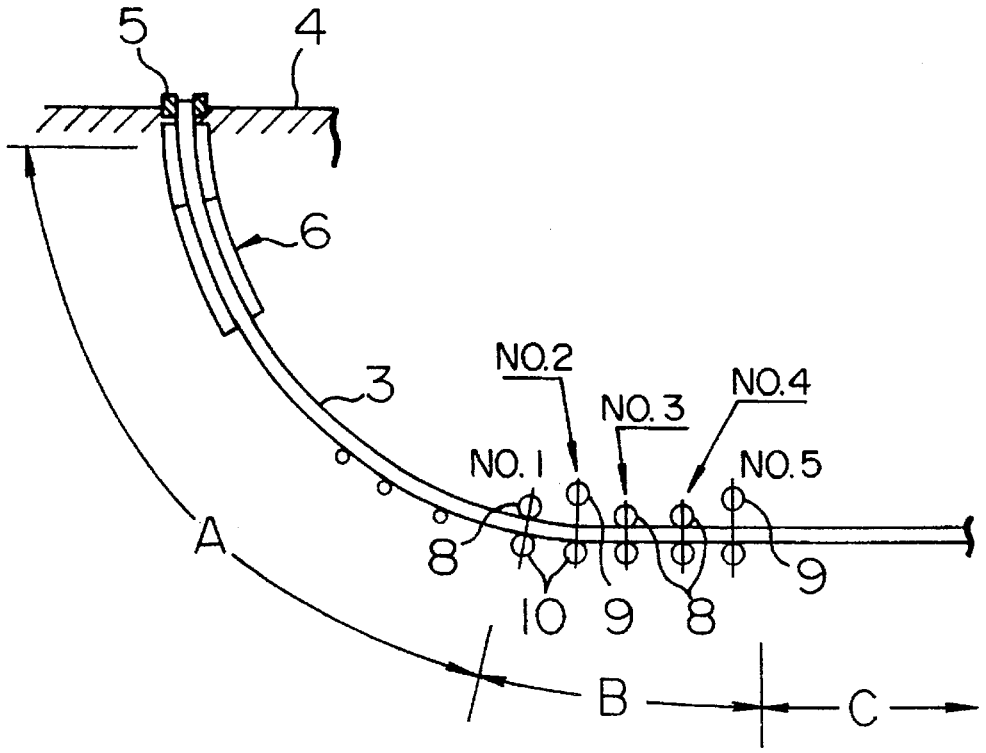
FIG. 4 is a schematic overall side view of a continuous casting machine according to the present invention.

The present invention will be explained for an embodiment by referring to the drawings. The embodiment is described for a case in which a deformed cast steel strand 3 having contact surface heights different from a press roller (hereinafter called a Z-cast steel strand) as shown in FIG. 3 is unbent and drawn in an unbending zone. Referring to FIG. 4, the continuous casting machine of the embodiment has, immediately below a casting mold 5 installed on a casting floor 4, a roller apron 6 which has a plurality of rollers commonly used for the cooling, guiding, and drawing of a cast steel strand, to form downward a substantially quadrant arc pass line (curving zone A). Unbending zone B including a group of cast steel strand press rollers and a group of dummy bar press rollers, which will be described later, extends from the lower end of curved zone A to horizontal section C at the exit. Prior to the start of casting, a dummy bar (not shown in FIG. 4) enters from the exit of curved section B to the position of the casting mold 5 through the group of pinch rollers in curved zone A. At the same time that casting is started, it supports the cast steel strand 3 fed from the casting mold 5 and being solidified, pressed between the group of pinch rollers in curved zone A, and the support roller and the group of press rollers in unbending zone B while transmitting a drawing drive force to the initial cast steel strand, and is drawn together with the cast steel strand. In this embodiment, unbending zone B is arranged with three cast steel strand press rollers 8 and two dummy bar press rollers 9 in the direction of the pass line, and correspondingly a support roller 10 is provided which rotates thereunder. In the figure, the rollers on stands Nos. 1, 3, and 4 are cast steel strand press rollers 8, and those on stands Nos. 2 and 5 are dummy bar press rollers 9.

Figure 5:
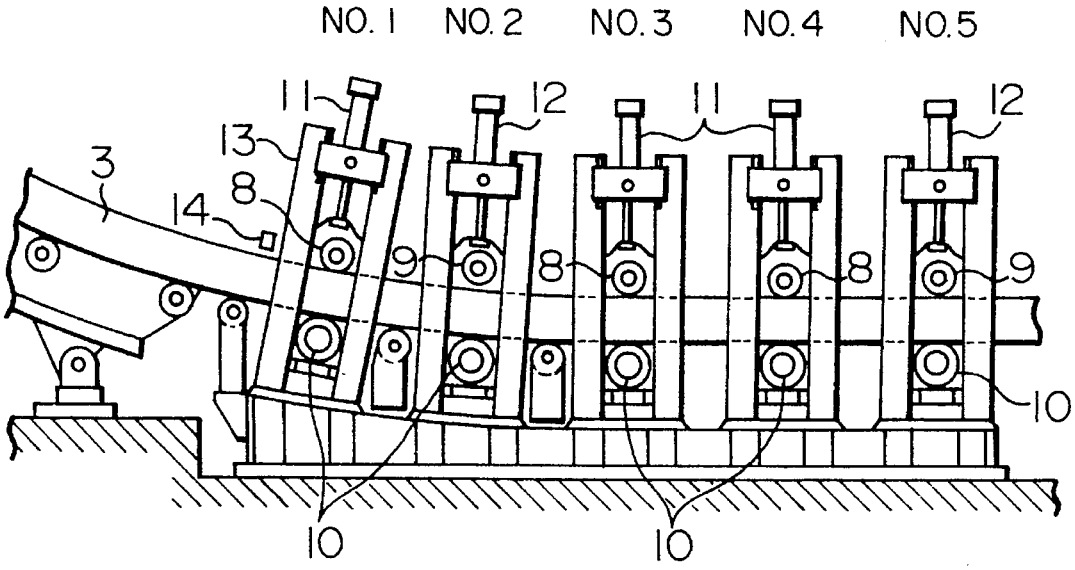
FIG. 5 is a side view showing an arrangement of press rollers in a unbending zone in a continuous casting machine of an embodiment of the present invention.

As shown in FIG. 5, three cast steel strand press rollers 8 and two dummy bar press rollers 9 are supported by a stand frame 13 in such a manner that they can be respectively pressed against and released from separate support rollers 10 below by individual press devices 11 and 12. Also, in this embodiment, a position detector 14 is placed near and in the front stage of the cast steel strand press roller 8 on stand No. 1 for detecting the passage of the cast steel strand and the dummy bar. The roller pressing devices 11, 12 are separately controlled for pressing and release by a press controller at a signal from the position detector 14. Thus, when a dummy bar passes through the cast steel strand press roller 8, the roller 8 is raised or released, while, when a cast steel strand passes through the position of the dummy bar press roller 9, the roller 9 is released so that these rollers do not obstruct the passage of these strand, respectively.

Figure 6:
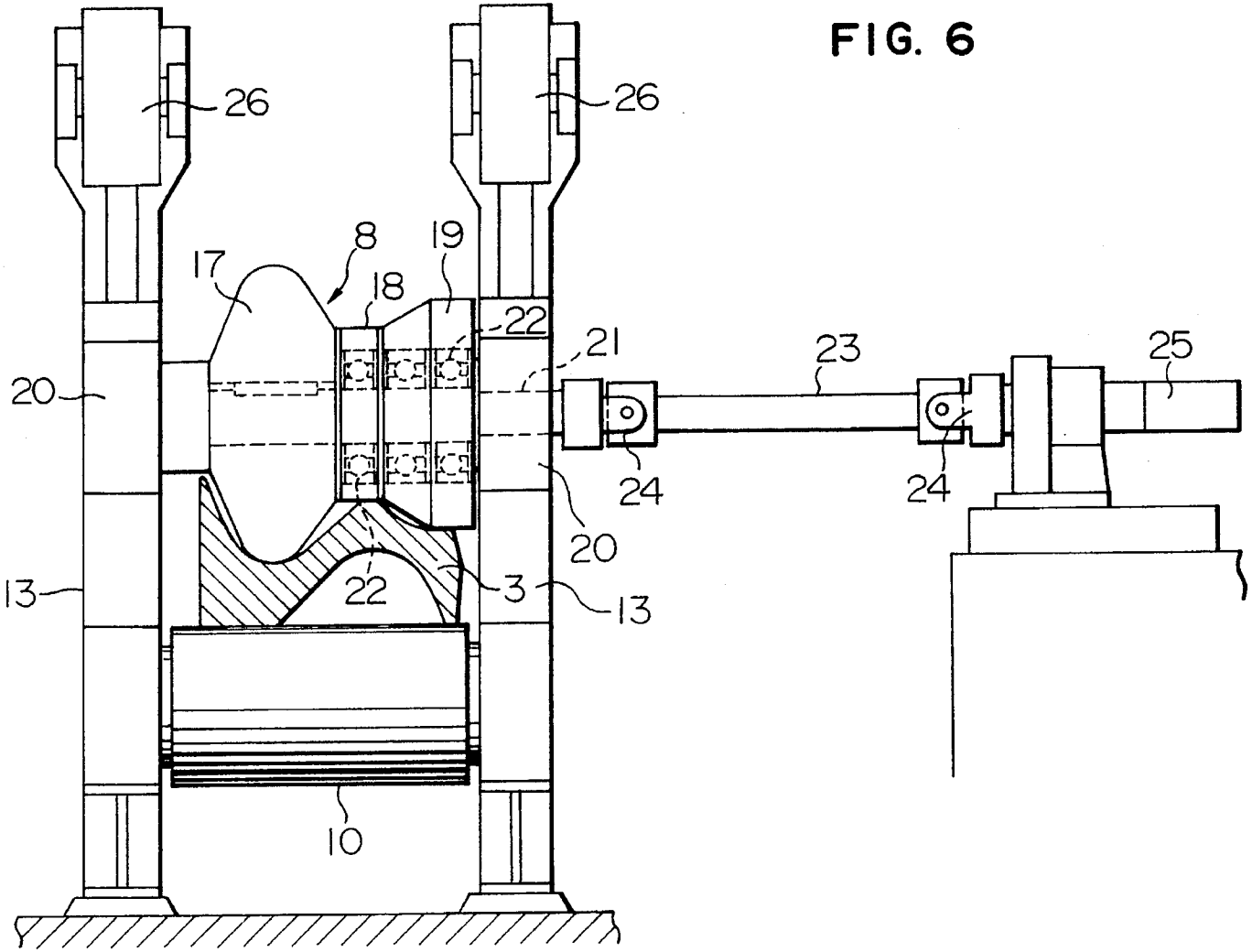
FIG. 6 is a front view of a cast steel strand press roller stand according to the embodiment of the present invention.

FIG. 6 is a front view showing a state where the Z-cast steel strand 3 is pressed by the cast steel strand press roller 8. The lower support roller 10 is a straight roller, and is journaled on a roller stand frame 13 enabling it to rotate. The upper press roller 8 consists of a drive roller component 17 having a larger diameter and a convex curved periphery, and two idle roller components 18, 19 having small and medium diameters, and thus constitutes an overall roller outer shape substantially along the top surface of the Z-cast steel strand 3. The drive roller component 17 with the larger diameter keyed to a drive shaft 21 journaled on roller chocks 20, and the other idle roller components 18, 19 with small and medium diameters are journaled on a drive shaft 21 through roller bearings 22 for free rotation. The drive shaft 21 is connected to a rotary drive motor 25 at the side of the roller stand through a connecting rod 23 and a universal joint 24. The roller chock 20 journaling the drive shaft 21 is held on the stand frames 13 so that it can be moved vertically by a cast steel strand press drive unit 26 which is installed on the top of the stand frames. The Z-cast steel strand 3 is pressed between the lower support roller 10 and the three upper roller components 17, 18, 19, and unbent in curved zone A, and drawn to subsequent horizontal zone C by the rotating drive of the drive roller component 17.

Figure 7:
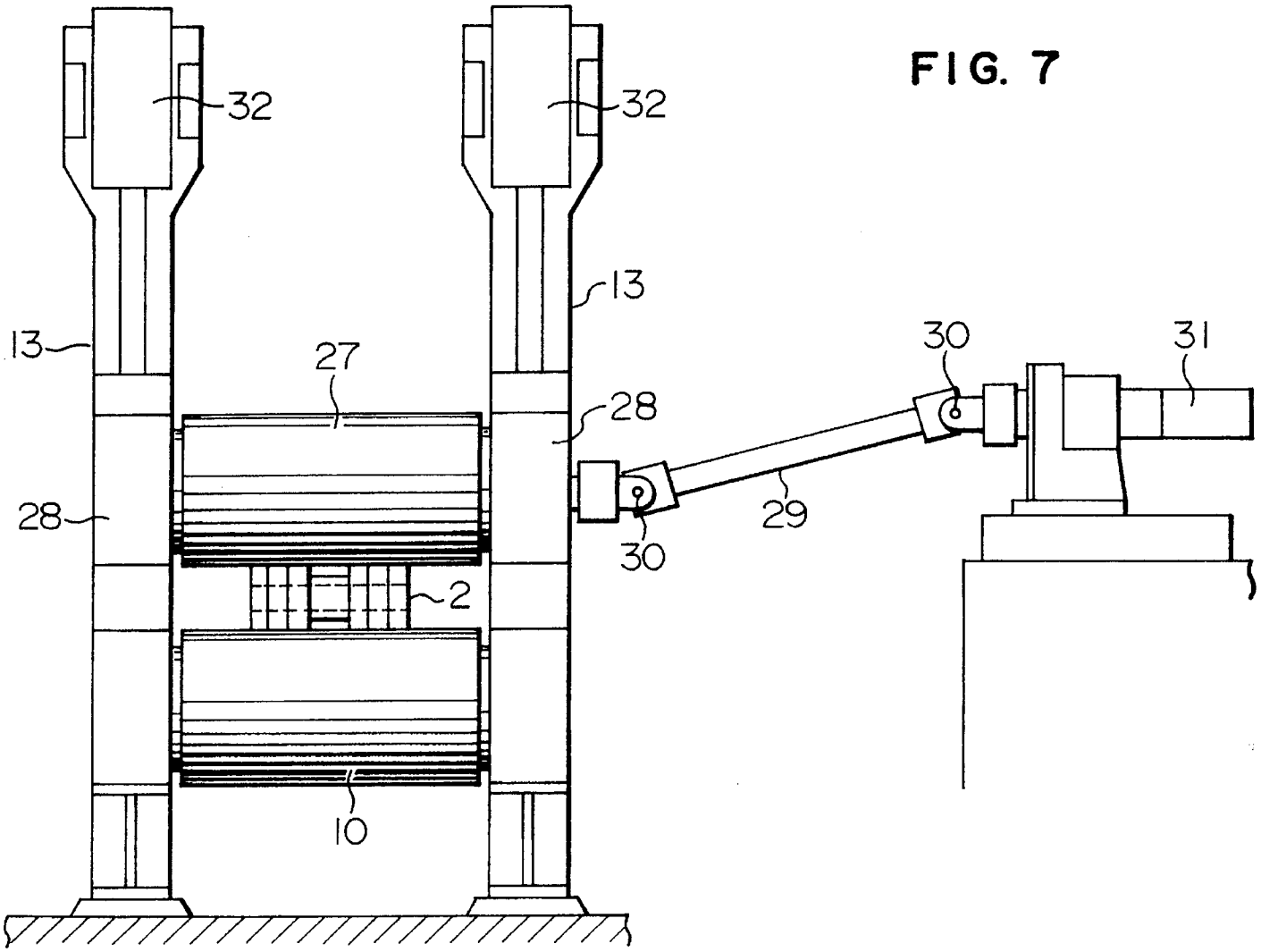
FIG. 7 is a front view of a dummy bar press roller stand according to the embodiment of the present invention.

FIG. 7 is a front view of a dummy bar press roller stand. Both the lower support roller 10 and the upper press roller 27 are straight in structure. The upper press roller 27 is journaled on roller chocks 28, which can move vertically along the stand frames 13, and connected to a rotary drive motor 31 at the side of one of frames 13 through a connecting rod 29 and the universal joint 30. The dummy bar 2 held between the lower support roller 10 and the upper press roller 27 is pressed by dummy bar press drive unit 32 on the top of the frames, and drawn to the exit by the rotating drive of the upper press roller 27.

Figure 8A:
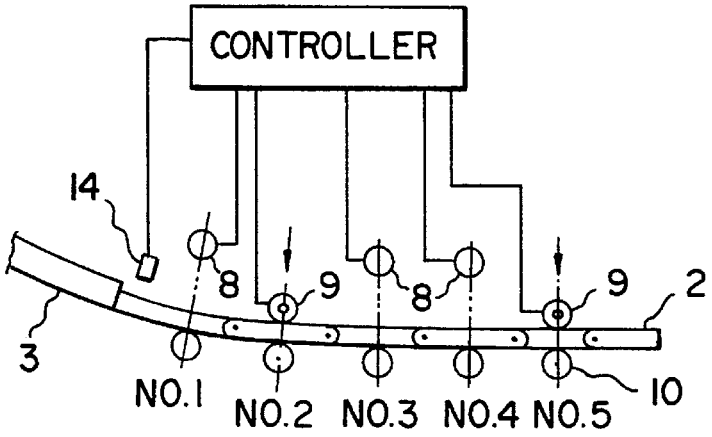
FIGS. 8A, 8B and 8C are schematic side view showing the operating state of the respective press rollers in the unbending zone according to the embodiment of the present invention.
Figure 8B:
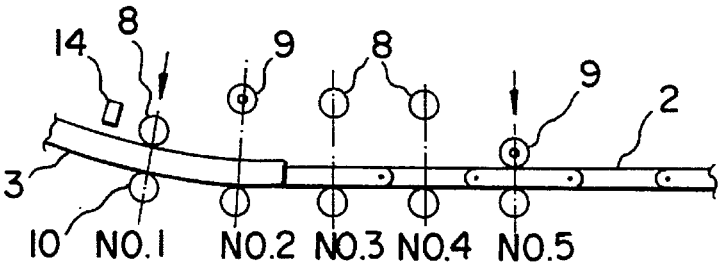
Figure 8C:
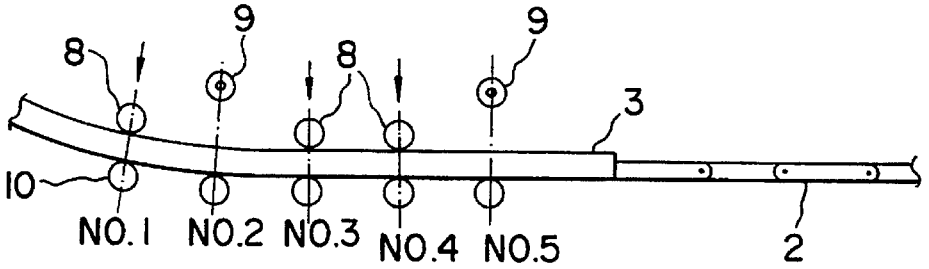

The operation of the respective press rollers when the dummy bar 2 and the Z-cast steel strand 3 pass through unbending zone B will be explained by referring to FIGS. 6–8. First, immediately before the start of casting, the dummy bar 2 is inserted into unbending zone B by the dummy bar press rollers 9 on stands Nos. 2 and 5, and held between the pinch rollers in curved zone A. At this moment, all of the cast steel strand press rollers 8 in unbending zone B are released. When casting is started, the dummy bar press rollers 9 on stands Nos. 2 and 5 are driven, and the dummy bar 2 is drawn (FIG. 8A). When the position detector 14 detects that the Z-cast steel strand 3 at the front end of the dummy bar head passes through the position of the cast steel strand press roller 8 on stand No. 1, the detection signal is sent to the press controller (not shown), and, after a predetermined period of time expires, an operating signal is input from the controller to the cast steel strand press drive unit 26 on stand No. 1 and the dummy bar press drive units 32 on stand No. 2 so that the cast steel strand press roller 8 on stand No. 1 is pressed and driven, the dummy bar press roller 9 on stand No. 2 is released (FIG. 8B), and the cast steel strand 3 is pressed and drawn by the press roller 8 on stand No. 1 (at the same time, the dummy bar 2 is also drawn by the press roller 9 on stand No. 5). Then, as the cast steel strand 3 passes through the press rollers 8 on stands Nos. 3 and 4, these press rollers 8 are sequentially pressed and driven, and the dummy bar press roller 9 on stand No. 5 is released so that the cast steel strand 3 is drawn to the subsequent horizontal section while being unbent by the pressure of the cast steel strand press rollers 8 on stands Nos. 1, 3, and 4 (FIG. 8C).

According to the present invention, it may be possible to provide the detector 14 at the entrance of stand No. 1, and sequentially control pressing or releasing of the respective press rollers by the controller upon receipt of a time-up signal in a predetermined period of time which expires after the detector detects the front end of the cast steel strand, or it may be possible to provides a detector on each stand, and to control the press roller on the stand by a controller with a detection signal from each detector. Of course, the arrangement of cast steel strand press rollers and dummy bar press rollers is not limited to the above embodiment. In addition, the present invention may be applied not only to a Z-cast steel strand as exemplified in FIG. 3, but also to any other deformed cast steel strand with different top roll contact surface heights.

As described above, according to the present invention, the cast steel strand press roller and the dummy bar press roller are separately provided in the unbending zone in the continuous casting machine, and respective rollers are pressed and released by detecting the advanced position of a dummy bar and an initial cast steel strand at the start of continuous casting so that even a deformed cast steel strand with different roll contact surface heights at each side can be effectively unbent and drawn without preventing the drawing of the dummy bar.

What is claimed is:

1. A Z-cast steel strand withdrawal/straightening unit for a continuous casting machine comprising:

a plurality of cast steel strand press roller stands and dummy bar press roller stands suitably arranged in the direction in which a cast steel strand is drawn at a withdrawal/straightening unit;

said cast steel strand press roller stand including support rollers rotatably supported thereon, a cast steel strand press roller rotatably supported thereon in opposite relation with said support rollers and having a cross section complementary to that of the Z-cast steel strand, and means for pressing and releasing said cast steel strand press roller against and from said support roller;

said dummy bar press roller stand including second support rollers rotatably supported thereon, a dummy bar press roller rotatably supported thereon in opposite relation with said second support rollers, and means for pressing and releasing said dummy bar press roller against and from said opposite second support rollers;

a detector for detecting the position of the cast steel strand in movement or the dummy bar in movement; and a controller for controlling to press or release said dummy bar press roller and said cast steel strand press roller depending on a detection signal of said detector.

2. A Z-cast steel strand withdrawal/straightening unit of claim 1, wherein:

said cast steel strand press roller consists of a drive roller component with a large diameter and convex periphery secured on a drive shaft and rotating therewith, a first idle roller component with a small diameter adjacent to said drive roller component and supported so as to be able to rotate on said drive shaft, and a second idle roller component with a medium diameter adjacent to said first idle roller component with a small diameter and supported so as to be able to rotate on said drive shaft.

* * * * *